United States Patent [19]

Kikuchi et al.

[11] Patent Number: 4,738,552

[45] Date of Patent: Apr. 19, 1988

[54] PLATEN GAP ADJUSTING MECHANISM OF PRINTER

[75] Inventors: Hiroshi Kikuchi; Yukio Ota; Toshihiro Nakano; Takashi Itaya; Shyoichi Watanabe; Kuniharu Hayashi, all of Tokyo, Japan

[73] Assignee: Oki Electric Industry Co., Ltd., Tokyo, Japan

[21] Appl. No.: 837,282

[22] Filed: Mar. 6, 1986

[30] Foreign Application Priority Data

Mar. 11, 1985 [JP] Japan ..... 60-33387[U]
Jun. 21, 1985 [JP] Japan ..... 60-92965[U]

[51] Int. Cl.[4] ..... B41J 11/20

[52] U.S. Cl. ..... 400/59; 400/55; 400/354; 400/320

[58] Field of Search ..... 400/55, 56, 57, 59, 400/352, 320, 353, 354, 354.1, 354.2, 354.3, 355, 356, 357

[56] References Cited

U.S. PATENT DOCUMENTS

| | | | |
|---|---|---|---|
| 565,728 | 8/1896 | Fairfield | 400/332.5 |
| 1,525,326 | 2/1925 | Seib | 400/298 |
| 2,741,355 | 4/1956 | Dodge | 400/332.6 |
| 2,986,259 | 5/1961 | Salzberger | 400/57 |
| 3,155,032 | 11/1964 | Antonucci | 400/58 |
| 3,666,071 | 5/1972 | Purr | 400/355 |
| 3,817,365 | 6/1974 | Zimmermann | 400/124 |
| 3,946,852 | 3/1976 | Watson et al. | 400/328 |
| 4,011,932 | 3/1977 | Wurscher et al. | 400/903 |
| 4,023,662 | 5/1977 | Perucca | 400/57 |
| 4,088,215 | 5/1978 | Bader | 400/56 |
| 4,243,331 | 1/1981 | Savage et al. | 400/59 |
| 4,268,177 | 5/1981 | Veale | 400/55 |
| 4,279,518 | 7/1981 | Blomquist et al. | 400/354 |
| 4,300,847 | 11/1981 | Hoffman et al. | 400/59 |
| 4,384,794 | 5/1983 | Okano et al. | 400/56 |
| 4,390,292 | 6/1983 | Krenz | 400/55 |
| 4,402,264 | 9/1983 | Weisgerber | 101/365 |
| 4,408,907 | 10/1983 | Bernardis | 400/124 |
| 4,420,269 | 12/1983 | Ackermann et al. | 400/56 |
| 4,469,459 | 9/1984 | Trezise et al. | 400/59 |
| 4,479,731 | 10/1984 | Kawaguchi | 400/357 |
| 4,514,101 | 4/1985 | Smith | 400/354 |
| 4,525,084 | 6/1985 | Ikeda | 400/55 |
| 4,526,486 | 7/1985 | Kikuchi et al. | 400/320 |
| 4,576,493 | 3/1986 | Staniszewski | 400/355 |
| 4,657,415 | 4/1987 | Kikuchi et al. | 400/355 |

FOREIGN PATENT DOCUMENTS

| | | | |
|---|---|---|---|
| 2913980 | 10/1980 | Fed. Rep. of Germany . | |
| 3521093 | 12/1985 | Fed. Rep. of Germany | 400/56 |
| 38148 | 3/1982 | Japan | 400/55 |
| 53465 | 3/1983 | Japan | 400/57 |
| 58-153682 | 9/1983 | Japan . | |
| 7076 | 1/1984 | Japan | 400/59 |
| 234763 | 6/1925 | United Kingdom . | |

*Primary Examiner*—David Wiecking
*Attorney, Agent, or Firm*—Wenderoth, Lind & Ponack

[57] ABSTRACT

A printer includes a platen having a longitudinal axis and a printing head mounted in opposition to the platen. The guide shaft is mounted to extend parallel to the axis of the platen. A carriage supports the printing head and includes a carriage frame mounted on the guide shaft for movement axially therealong and for movement rotatably thereabout and a base plate having a first end integral with the carriage frame and a second end directed away therefrom. A guide plate is fixed at a position below the second end of the base plate and extends parallel to the guide shaft. A parallel link mechanism includes a fixing member attached to a lower surface of the second end of the base plate and a slider memebr connected to the fixing member. The slider member has a slot within which fits the guide plate, such that movement of the carriage axially of the guide shaft causes the parallel link mechanism and the second end of the base plate to be guided by the guide plate. An adjusting screw is threaded through a hole in the second end of the base plate and has a tip end in engagement with the slider member. Thus, upon rotation of the adjusting screw the slider member and the second end of the base plate are moved relatively toward or away from each other, thereby moving the carriage and the printing head rotatably about the guide shaft to increase or decrease the platen gap. A flexible member connects the slider member to the fixing member to prevent the slider member from becoming inclined relative to the guide plate.

6 Claims, 10 Drawing Sheets

PLATEN GAP ADJUSTING MECHANISM OF PRINTER

BACKGROUND OF THE INVENTION

1. Field of the Invention:

The present invention relates to a printer and more particularly to a mechanism for adjusting a gap (hereafter referred to as a platen gap) between a platen and a printing head.

2. Description of the Prior Art:

A printer is known wherein a carriage having a printing head mounted thereon is movably mounted on a guide shaft, and with the printing head moved parallel to a platen, characters are printed on a printing paper held on the platen.

A printer of this type must ensure that the platen gap is of proper size to assure high quality printing and thus includes a platen gap adjusting mechanism.

Such a platen gap adjusting mechanism is described for example in Japanese Laid-Open Patent Publication No. 58-90975. According to this platen gap adjusting mechanism, an eccentric bushing is rotatably fitted in a carriage, a guide shaft penetrates the bushing, and the printing head is moved integrally with the bushing and carriage to adjust the platen gap.

Another example of a platen gap adjusting mechanism is described in Japanese Laid-Open Utility Model Publication No. 58-175951. With this platen gap adjusting mechanism, the thrust bearing member one of two guide shafts is made eccentric and is rotatably engaged with the carriage, and the eccentric bearing is arbitrarily rotated to adjust the plate gap.

However, such a platen gap adjusting mechanism suffers from the disadvantages that: (1) adjustment with the eccentric bush is difficult, and (2) the mechanism is complicated and thus expensive.

Furthermore, a serial printer is known and described in Japanese Laid-Open Utility Model Publication No. 58-28851.

The serial printer includes a guide rail having rack teeth formed over the surface of a rack and disposed parallel to a platen for supporting a printing paper. A printing head has a motor, a pinion is fixedly mounted on a rotary shaft of the motor, and a guide piece is formed on the bottom surface of the printing head. The pinion of the motor and the rack of the guide rail are intermeshed to hold the guide rail between the pinion and the guide piece. Upon rotation of the motor, the motor and the printing head are integrally moved on the guide rail due to thrust force caused by engagement between the pinion and the rack, and thereby printing is effected.

However, such a printer suffers from the disadvantage that the guide rail is held between the pinion fixedly mounted on the rotary shaft of the motor and the guide piece formed on the bottom surface of the printing head. As a result, the printing head cannot be moved perpendicularly to the axial direction of the platen. Therefore, adjustment of the platen gap is very difficult.

SUMMARY OF THE INVENTION

It is an object of the present invention to provide a platen gap adjusting mechanism capable of adjusting a platen gap with ease.

Another object of the present invention is to provide an inexpensive plate gap adjusting mechanism having a simple structure.

According to the present invention these objects are achieved by the provision of a platen gap adjusting mechanism including: a carriage rotatably mounted at a front end thereof on a guide shaft, a fixed guide plate provided below a rear end of the carriage and extending substantially parallel to the guide shaft over the extent of carriage movement, and a screw hole provided above the guide plate in the rear end of the carriage, and an adjusting screw threaded in the screw hole from above and brought into contact with a slider part of a parallel link member or the guide plate.

The above and other objects, features and advantages of the present invention will become more apparent from the following description taken in conjunction with the accompanying drawings in which preferred embodiments of the present invention are shown by way of illustrative example.

DESCRIPTION OF THE PREFERRED EMBODIMENT

One embodiment of a platen gap adjusting mechanism according to the present invention will be described with reference to FIGS. 1–3 of the accompanying drawings.

Figure 1:
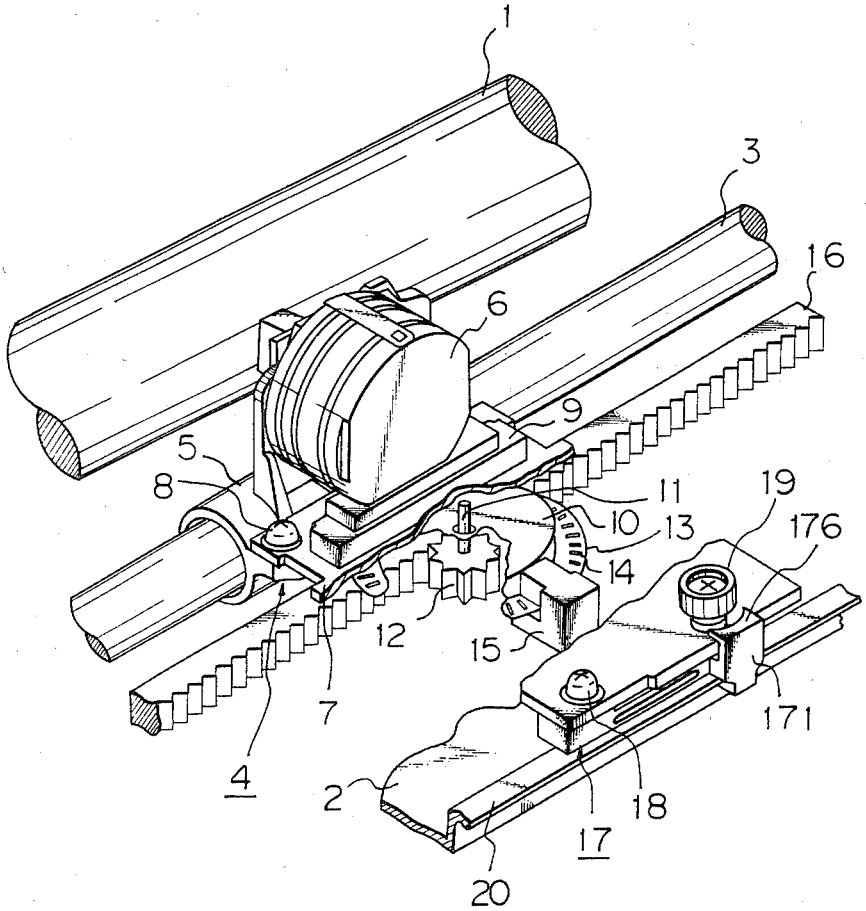
FIGS. 1, 4, 7 and 10 are perspective views, partly cut away, illustrating platen gap adjusting mechanisms according to the invention.

As shown in FIG. 1, designated at 1 is a platen supporting a printing paper (not shown) and having opposite ends rotatably supported on side plates (not shown) of a base plate 2. Designated at 3 is a guide shaft disposed parallel to the plate 1 and having opposite ends fixed on the side plates. Designated at 4 is a carriage with a base plate 7, described below, and a carriage frame 5 having a cylindrical part mounted rotatably on the guide shaft 3 and movable therealong in the axial direction. Therefore, the carriage 4 is rotatable around the guide shaft 3 as well as movable axially along the guide shaft 3. Designated at 6 is a printing head which is mounted on the carriage 4 and thus is adapted to move relative to the platen 1 with the movement of the carriage 4.

Base plate 7 is fixed to carriage frame 5 by spring bolts 8. The base plate 7 has thereon a connector 9 which is connected with a base plate (not shown) provided on the bottom of the printing head 6 for delivering and receiving a printing head control signal. A motor 10 is fixed on the lower surface of the base plate 7. A rotary shaft 11 of the motor 10 extends through base plate 7 (see FIG. 2). A pinion 12 is mounted on the rotary shaft 11, 13 is a slit disk for controlling the rotation of the motor 10 and having formed therein a plurality of slits 14, 15 is a sensor for detecting the slits 14, 16 is a rack having opposite ends fixed on the side plates of the base plate 2 and engaged with the pinion 12. By such structure the carriage 4 is moved at a prescribed speed along the guide shaft 3. Namely, when motor 10 is driven the rotary shaft 11 thereof is rotated, and thereby the pinion 12 mounted on the rotary shaft 11 is also rotated. Thereupon, since the pinion 12 and the rack 16 are in engagement with each other, the carriage 4 and base plate 7 move at a prescribed speed along the guide shaft 3.

A parallel link member 17 is fixed on the lower surface of the base plate 7 by means of a screw 18. An adjusting screw 19 is threaded through an opening in the base plate 7 and has a tip brought into contact with a surface 177 of a slider part 171 described later (refer to FIG. 3) of the parallel link member 17. The parallel link member 17 is constructed by connecting slider part 171, having therein a slot or slit 170 engaging with a guide plate 20 described later, with a fixing part 173, having a screw hole 172 for the screw 18, by means of two parallel flexible plate-shaped parts 174, 175, and is integrally formed by resin molding. Designated at 176 is a stopper integrally formed with the slider part 171 for restricting the rotation of the carriage 4, and the surface 177 is in contact with the adjusting screw 19.

As shown in FIG. 1, guide plate 20 is integrally formed with the base plate 2 or may be mounted on the base plate 2, and engaging slit 170 of the slider part 17 is slidably engaged over guide plate 20.

Figure 2:
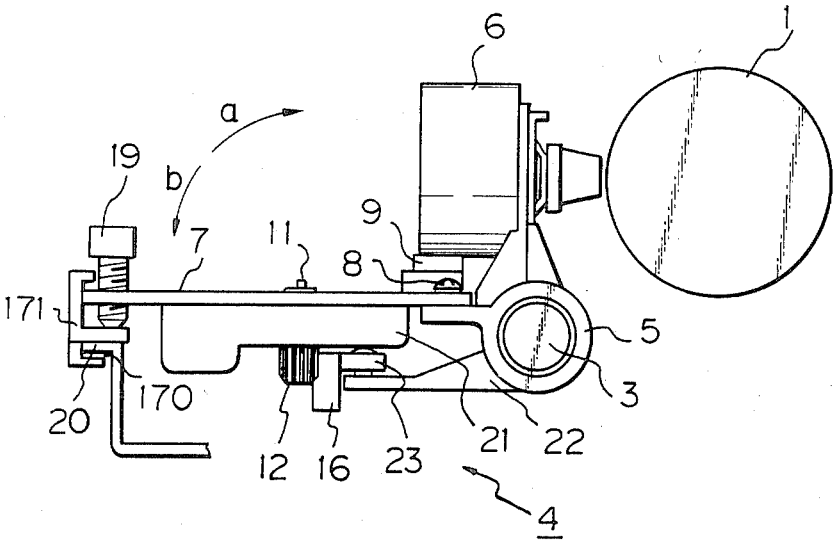
FIGS. 2, 5, 6, 8, 9, and 11 are side elevational views illustrating the respective platen gap adjusting mechanisms.
Figure 3:
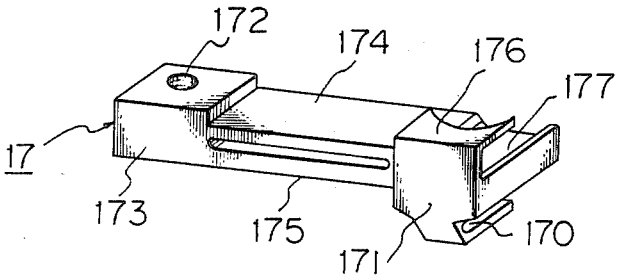
FIG. 3 is a perspective view illustrating a parallel link member.

In FIG. 2 illustrating a portion of the printer, designated at 21 is a cover for covering the motor 10, slit disk 13, and sensor 15 of FIG. 1. An arm 22 is provided on the carriage frame 5, and a roller 23 is rotatably fixed on the art 22 and engages the rack 16.

A platen gap adjusting mechanism will be described with reference to FIG. 2.

A procedure for reducing the distance between the surface of the plate 1 and the tip end surface of the printing head 6 facing the plate surface, i.e. a platen gap, first will be described.

In this case, the adjusting screw 19 is rotated such that the tip end thereof moves toward the surface 177 of the slider part 171 and away from base plate 7. Thereby, the slider part 171 is pressed by the screw 19 and engages with the guide plate 20 through the engaging slit 170. Accordingly, the flexible plate-shaped parts 174, 175 between the slider part 171 and the fixed part 173 are deflected, whereby the fixed part 173 is raised relative to the slider part 171. The flexible plate-shaped parts 174, 175 are deflected such that the slider part 171 is prevented from being inclined with respect to the guide plate 20, thus keeping a parallel relation therebetween. As a result of the above, the rear end of the base plate 7 is pushed up and thereby the carriage frame 5 on which the base plate 7 is fixed is rotated around the guide shaft 3 in the direction of arrow a in FIG. 2. Since the printing head 6 is fixed on the carriage frame 5, the printing head 6 is also rotated in the direction of arrow a and the tip end surface thereof is brought toward the surface of the platen 1. Thus, the platen gap can be reduced.

Next, a procedure for increasing the platen gap will be described. In this case, the adjusting screw 19 is rotated in a direction opposite to that described above, and thereby the tip end thereof is moved back toward the base plate 7. Hereupon, the flexible plate-shaped parts 174, 175 return to their original flat state due to their inherent resiliency or restoring force. As a result of the above, the rear end of the base plate 7 is lowered, whereby the carriage frame 5 is rotated around the guide shaft 3 in the direction of arrow b with the printing head 6 rotated integrally with the carriage frame 5, and thus the tip end surface of head 6 is separated from the surface of the platen 1. In such a manner, the plate gap is increased.

Since the platen gap can be increased or decreased as described above, the platen gap can be adjusted to the optimum for printing by rotating the adjusting screw 19 in the desired direction.

The platen gap adjustment operation of the present embodiment is as described above, and thereafter the platen 1 supports a printing paper (not shown). An inked ribbon cassette is mounted on the base plate 7 and printing is effected by means of the printing head 6.

The carriage 4 is, in the above printing operation, moved along the guide shaft 3 due to rotation of the pinion 12, in engagement with the rack 16, mounted on the rotary shaft 11 rotated by driving the motor 10, and thereby the slider part 171 of the parallel link member 17 fixed on the base plate 7 is forced to slide on the upper surface of the guide plate 20. Even with the flexible plate-shaped parts 174, 175 of the parallel link member 17 deflected due to adjustment of the platen gap, the slider part 171 is not inclined with respect to the guide plate 20, as described above, and thus the carriage 4 is moved smoothly.

Figure 4:
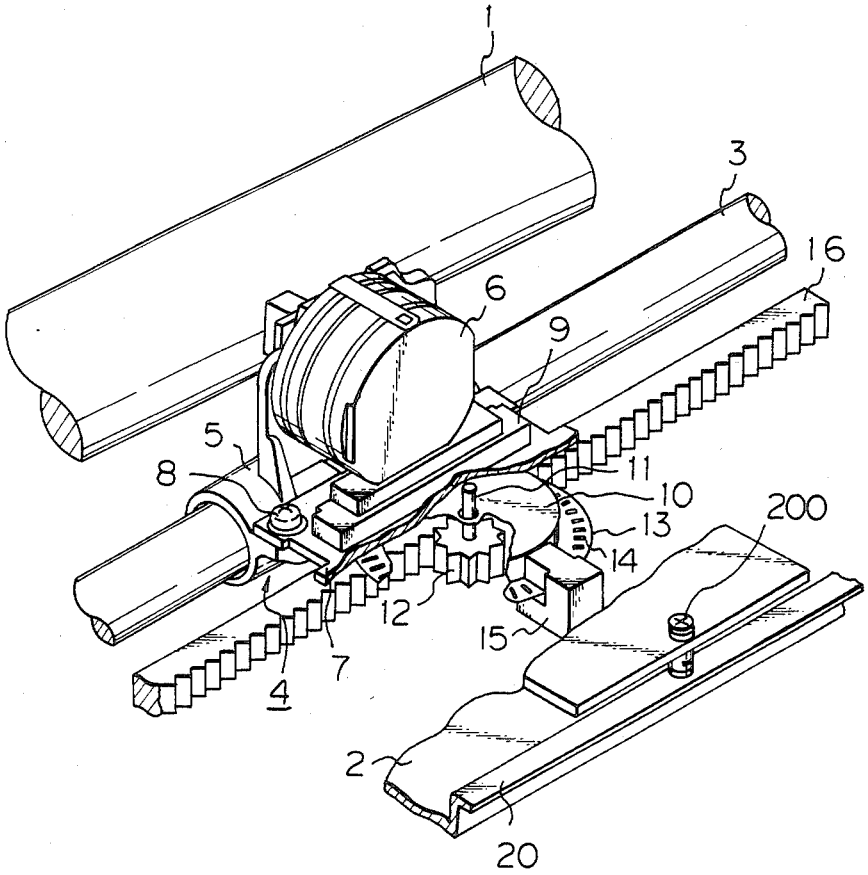
Figure 5:
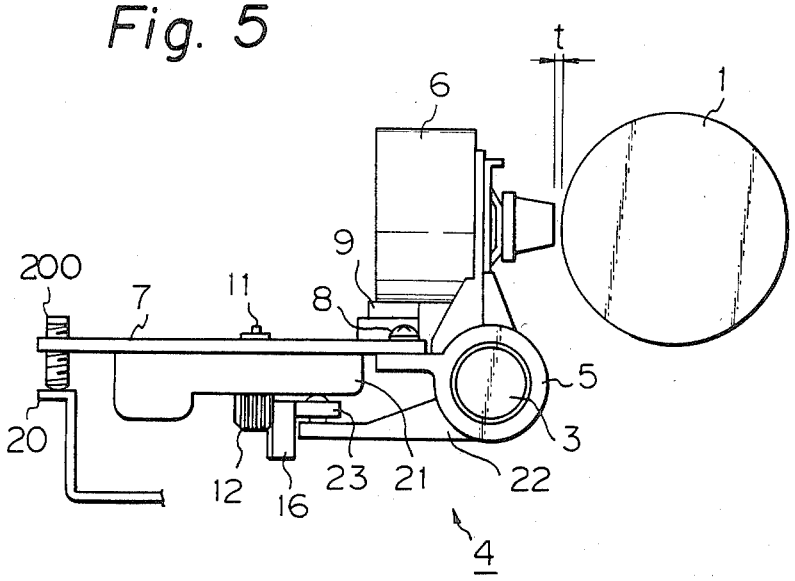
Figure 6:
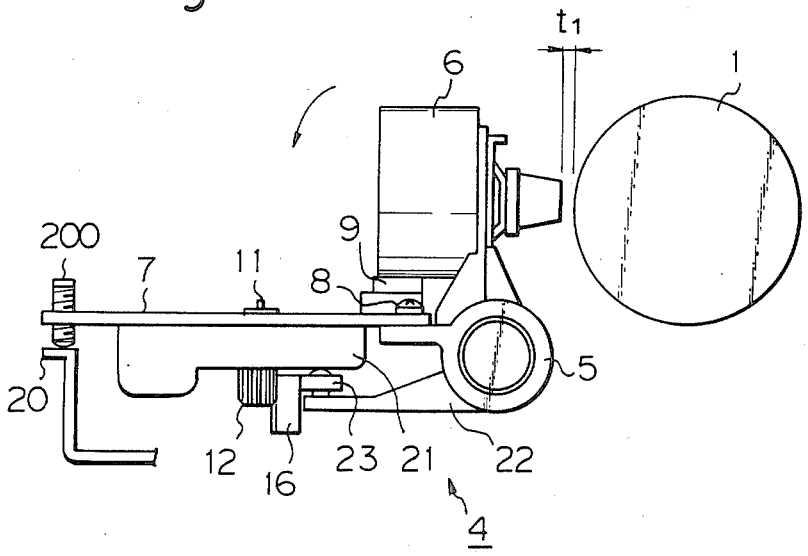

Another platen gap adjusting mechanism now will be described. The illustration of FIG. 4 is the same as that of FIG. 1 except for the rear end of the base plate 7. The platen gap adjusting mechanism will be described with reference to FIGS. 5 and 6. In such figures, designated at 200 is an adjusting screw, the tip end of which is in slidable contact with the guide plate 20. First, in a state with the platen gap 5 shown in FIG. 4, adjusting screw 200 is rotated counterclockwise with respect to the right hand thread shown therein. Hereupon, since the tip end of the adjusting screw 200 is in contact with the guide plate 20, the rear part of the base plate 7 is lowered with such rotation of the adjusting screw 200. Thereby, the carriage frame 5 on which the base plate 7 is fixed is rotated around the guide shaft 3 in the direction shown by an arrow in FIG. 6. The printing head 6 is, since it is fixed to the carriage frame 5, also rotated in the direction of the arrow, and thereby the tip end surface thereof is moved away from the surface of the platen 1. Accordingly, the platen gap is increased as shown in FIG. 6 to $t_1$, where $t_1 > t$. Upon rotating adjusting screw 200 in a direction opposite to the above description, the tip end surface of the printing head 6 is moved toward the platen 1 surface to reduce the platen gap.

Figure 7:
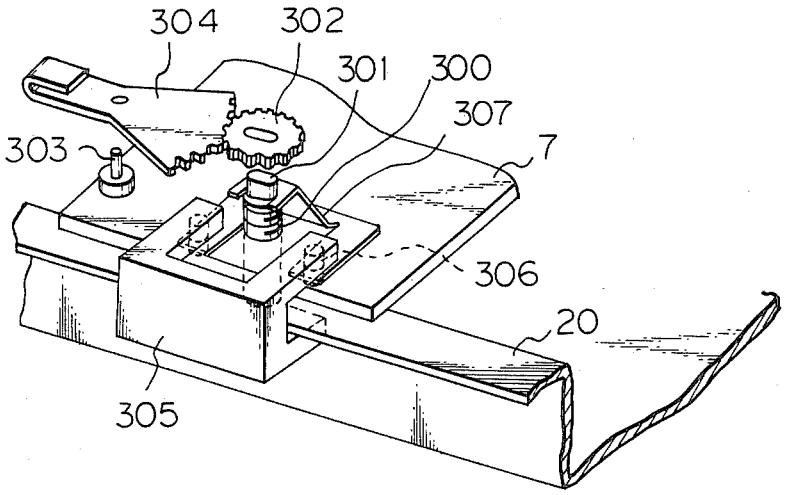

Next, another platen gap adjusting mechanism will be described. The illustration of FIG. 7 is similar to that of FIG. 1 except for the rear end of the base plate 7. The platen gap adjusting mechanism in the present embodiment will be described with reference to FIGS. 8 and 9. In such figures, designated at 300 is an adjusting screw having an upper end in the form of an integral flattened mounting shaft 301, onto which is fitted a gear 302 for movement up and down relative thereto. Designated at 303 is a support shaft provided on the base plate 7. 304 is a gap changeover lever rotatably mounted on the support shaft 303. The gap changeover lever 304 has a lug on one end thereof, the other end of which is fan-shaped. Gear teeth engaging with the gear 302 are provided on the fan-shaped end of the lever 304. Designated at 305 is a slider having a C-shaped cross section. A lower part of slider 305 is located on the lower surface side of the guide plate 20, and on an upper part of slider 305 are posts 306 extending toward the lower part of the slider and fitted in holes provided in the base plate 7. Designated at 307 is a leaf spring, and the gear 302 is biased upwardly so as to be engaged with the teeth of gap changeover lever 304 by an arm formed in the central part of the leaf spring 307. One end of the leaf spring 307 acts on the lower side of the upper part of the slider 305 and thus pushes the slider 305 upwardly. Thereby, the lower part of the slider 305 is urged against the lower surface of the guide plate 20.

Figure 8:
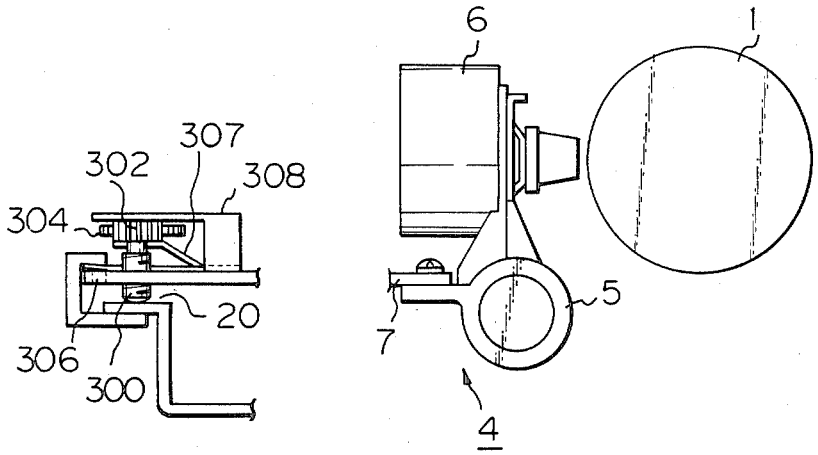
Figure 9:
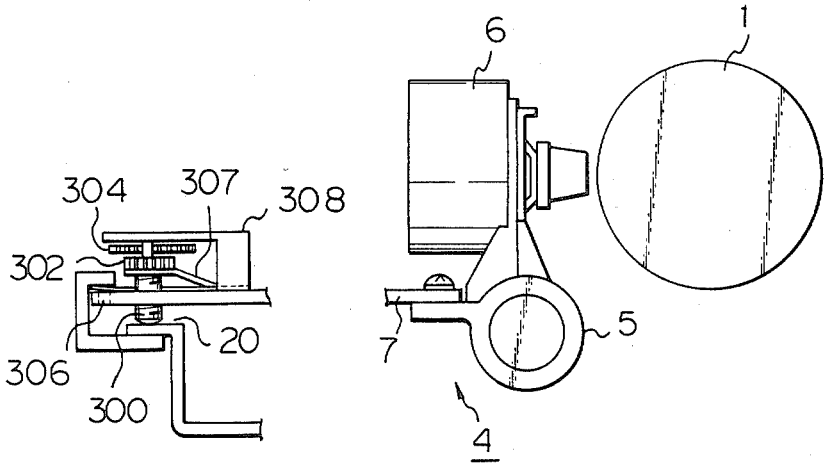

Next, operation of this embodiment of the platen gap adjusting mechanism will be described with reference to FIGS. 8 and 9. A press member 308 prevents the gear 302 from being lifted from the mounting shaft 301 and also fixes the leaf spring 307 on the base plate 7. As shown in FIG. 8, the gear 302 fitted movably up and down in the mounting shaft 301 integral with the adjusting screw 300 is biased upwardly by the leaf spring 307 and meshes with the gap changeover lever 304. Then, by pushing the gear 302 down from such position against the force of the leaf spring 307, the gear 302 is released from the meshing engagement with the gap changeover lever 304 (refer to FIG. 9). Thereafter, upon rotating the gear 302 clockwise or counterclockwise by means of fingers, etc., the adjusting screw 300 is rotated integrally with the gear 302, and thereby the rear part of the base plate 7 is moved upwardly or downwardly. Accordingly, the carriage 4 is rotated clockwise or counterclockwise together with the printing head 6 around the guide shaft 3, and thereby the platen gap is changed and thus adjusted to a desired value. In such a manner, an initial setting of the size of the platen gap is effected, which size may have been predetermined for use as a reference.

Then, by releasing the gear 302, the gear 302 is pushed up by the restoring force of the leaf spring 307 and again meshes with the gap changeover lever 304. Thereafter, the platen gap may be finely adjusted by holding the lug on one end of the gap changeover lever 304 between the operator's fingers and turning the lever in a desired direction about shaft 303. Thus, the adjusting screw 300 is rotated via the gear 302, and thereby the carriage 4 is rotated around the guide shaft 3 together with the printing head 6. Accordingly, a proper size of the platen gap can be assured as a function of, e.g., the thickness of a printing paper to be used.

Moreover, it is likely that, when adjusting the platen gap, the pinion 12 will strike the rack 16. As a countermeasure to such occurrence, it is possible to provide a proper backlash between the rack 16 and the pinion 12, or to allow the rack 16 to have a certain measure of flexibility. With such countermeasure, the amount of rotation of the carriage 4 occurring when adjusting the platen gap can be absorbed without any practical difficulty.

Figure 10:
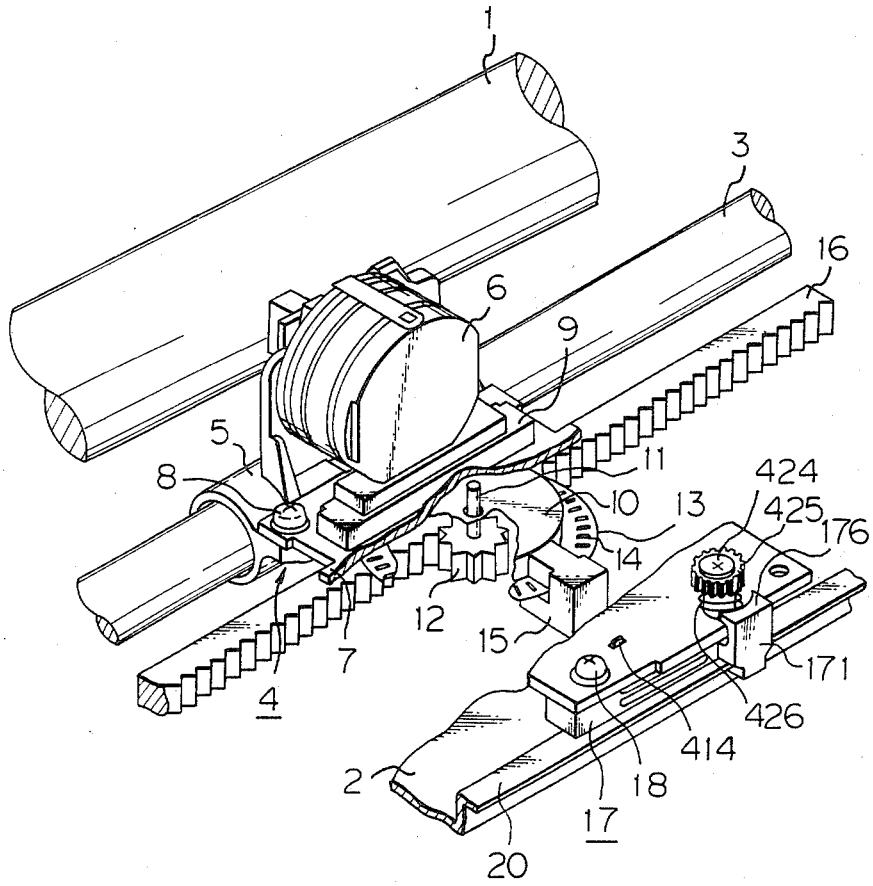
Figure 11:
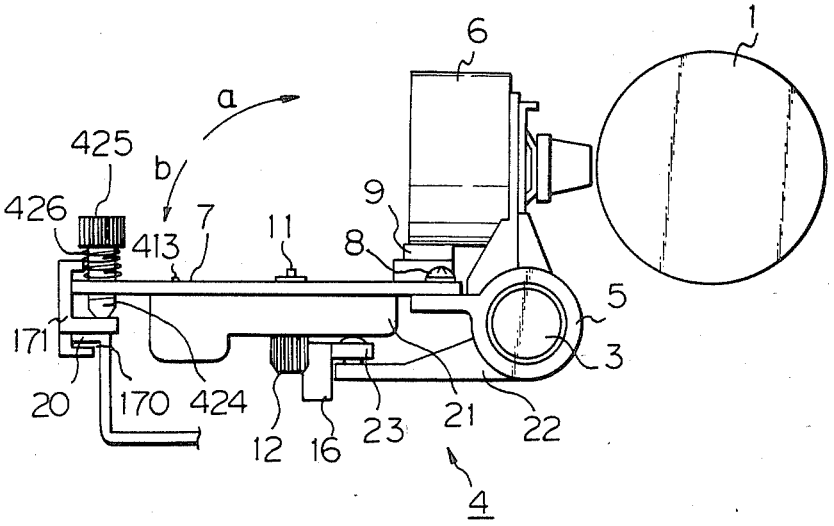

Another platen gap adjusting mechanism now will be described. The illustration of FIG. 10 is the same as that of FIG. 1 except for the rear end of the base plate 7. FIG. 11 is also the same as FIG. 2 except for the rear end of the base plate 7. Moreover, the parallel link member 17 of FIG. 10 is the same as that of FIG. 1.

In the following, the rear end of the base plate 7 shown in FIGS. 10–13 will be described with reference thereto.

Figure 12:
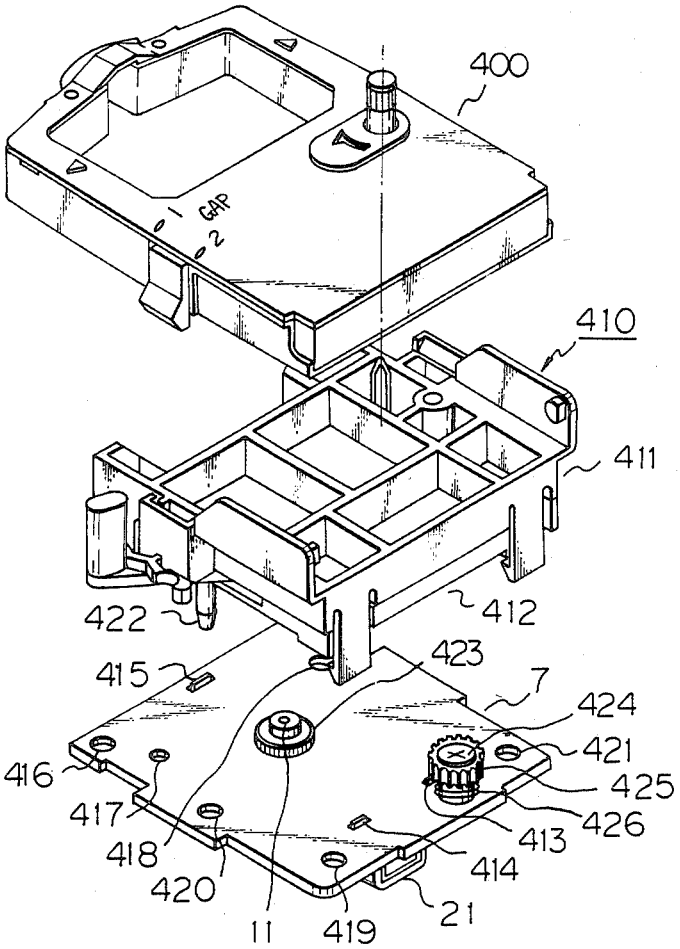
FIG. 12 is an exploded perspective view illustrating an inked ribbon cartridge, a pedestal, and a base plate for mounting the inked ribbon cartridge and the pedestal.

In FIG. 12 is shown an inked ribbon cartridge pedestal 410 to be mounted on the upper part of the base plate 7 and an inked ribbon cartridge 400 to be mounted on the pedestal 410. Designated at 413, 414, and 415 are pawls for fixing the cover 21 to the base plate 7, 416 is a hole in plate 7 for receiving a mounting screw, 417 and 418 are holes for mounting connector 9, 419 is a hole for mounting screw 18, and 420 and 421 are holes for mounting the inked ribbon cartridge pedestal 410, a projection 422 of the inked ribbon cartridge pedestal 410 being inserted into the hole 420. In addition, another projection of pedestal 410 (not shown) is inserted into the hole 421. Designated at 423 is a gear mounted on shaft 11 of the motor 10, 424 is an adjusting screw, 425 is a gear, and 426 is a coil spring. The adjusting screw 424 is screwed into a screw hole provided in the base plate 7, and the tip end of the adjusting screw 424 makes contact with the surface 177 of the slider part 171 of the parallel link member 17 in the same way as the adjusting screw 19 of FIG. 1. Accordingly, the adjusting screw 424 serves in the same way as the adjusting screw 19 with respect to the adjustment of the platen gap. Gear 425 is mounted on the adjusting screw 424 for movement up and down with respect thereto. Coil spring 426 is provided between the base plate 7 and the gear 425 and acts to urge the gear 425 to an upper position limited by the adjusting screw 424.

Figure 13:
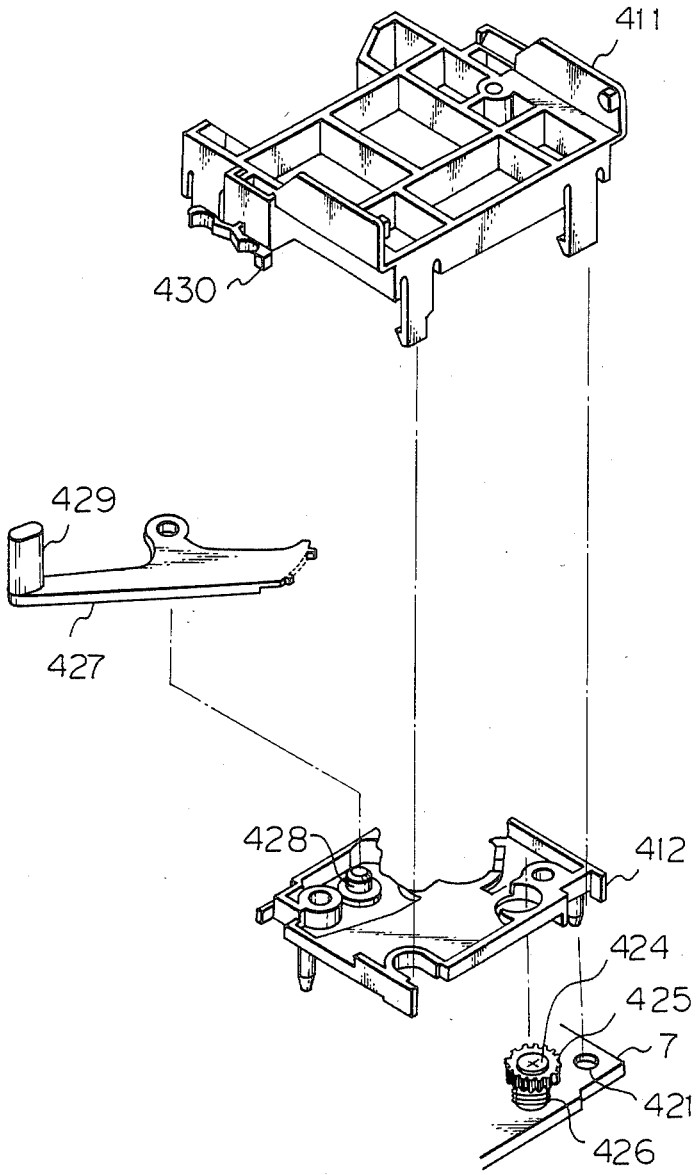
FIG. 13 is an exploded perspective view of the inked ribbon cartridge pedestal.

Referring to FIG. 13 illustrating the inked ribbon cartridge pedestal 410 in detail, the inked ribbon cartridge pedestal 410 comprises upper and lower pedestal portions 411 and 412. The lower pedestal portion 412 has a shaft 428 for mounting thereon a gap changeover lever 427 that is rotatable around shaft 428. One end of the gap changeover lever 427 is fan-shaped and has teeth formed therein. The teeth can engage with the gear 425 when the inked ribbon cartridge pedestal 410 is mounted on the base plate 7. A projection 430 is provided on the upper pedestal portion 411 and has concave recesses for receiving a lug 429 on another end of the gap changeover lever 427 in alternate pivoted positions thereof about shaft 428.

The operation of adjusting the platen gap now will be described.

First, the gear 425 fitted movably up and down on the adjusting screw 424 is urged upwardly by the coil spring 426 and thereby meshes with the teeth of gap changeover lever 427. Then, the gear 425 is forced down against the force of the coil spring 426, whereby the gear 425 is released from meshing engagement with the gap changeover lever 427. Thereafter, upon turning the adjusting screw 424 clockwise or counterclockwise, the rear part of the base plate 7 is moved vertically. Consequently, the carriage 4 is rotated clockwise or counterclockwise around the guide shaft 3 together with the printing head 6, whereby the platen gap is altered. Namely, an initial setting of the size of the platen gap is effected, and this provides a predetermined reference. This is conducted with lug 429 of the gap changeover lever 427 positioned in a recess of projection 430 corresponding to a position GAP1 shown in FIG. 12, thus setting a platen gap size for GAP1. Then the gear 425 is returned to the original state in meshing engagement with the gap changeover lever 427. The same operation is conducted to set a platen gap size for setting GAP2. Thereafter, the platen gap is adjusted by moving the lug 429 of the gap changeover lever 427 between the GAP1 and the GAP2 positions. Thereupon, the adjusting screw 424 is rotated via the gear 425 whereby the carriage 4 is rotated around the guide shaft 3 together with the printing head 6 so that the platen gap can be adjusted between such two settings, e.g. depending on the thickness of the printing paper used. Although in the above description, the gap changeover lever 427 is movable between two fixed positions, any number of such fixed positions may be provided.

The embodiments of the platen gap adjusting mechanism described above include a motor on the carriage for moving the carriage and a pinion mounted on the rotary shaft of the motor and engaging with a rack extending parallel to the guide shaft. It is however a matter of course that the present invention is not limited to such features. Namely, other arrangements, such as fixing the carriage on a wire or a belt without carrying the motor on the carriage and moving the wire or the belt by use of a motor, would allow the same platen gap adjustment.

Although certain preferred embodiments have been shown and described, it should be understood that many changes and modifications may be made thereto without departing from the scope of the invention.

What is claimed is:

1. In a printer including a platen for supporting a printing paper and having a longitudinal axis and a printing head mounted in opposition to said platen with a platen gap therebetween, the improvement comprising means for adjusting the size of said platen gap, said means for adjusting comprising:

a guide shaft mounted to extend parallel to said axis of said platen;

a carriage supporting said printing head and including a carriage frame mounted on said guide shaft for movement axially therealong and for movement rotatably thereabout and a base plate having a first end integral with said carriage frame and a second end directed away therefrom;

a guide plate fixed at a position below said second end of said base plate and extending parallel to said guide shaft;

a parallel link mechanism including a fixing member attached to a lower surface of said second end of said base plate and a slider member connected to said fixing member, said slider member having therein a slot within which fits said guide plate, whereby upon movement of said carriage axially of said guide shaft, said parallel link mechanism and said second end of said base plate are guided by said guide plate;

adjusting screw means, threaded through a hole in said second end of said base plate and having a tip end in engagement with said slider member, for, upon rotation within said hole, moving said slider member and said second end of said base plate relatively toward or away from each other and thereby moving said carriage and said printing head rotatably about said guide shaft to increase or decrease said platen gap; and said parallel link mechanism including means for, upon said moving said slider member and said second end of said base plate relative to each other, preventing said slider member from becoming inclined relative to said guide plate and thereby maintaining a parallel relation therebetween, said means for preventing comprising flexible means connecting said slider member to said fixing member.

2. The improvement claimed in claim 1, wherein said flexible means comprises at least one deflectable plate-shaped member connecting said slider member to said fixing member.

3. The improvement claimed in claim 2, wherein said at least one plate-shaped member comprises two parallel plate-shaped members.

4. The improvement claimed in claim 2, wherein said fixing member, said slide member and said at least one plate-shaped member are integrally formed of molded resin.

5. The improvement claimed in claim 1, further comprising a gear mounted on said adjusting screw means for axial movement relative thereto, a changeover lever mounted on said carriage for rotation about a pivot axis and having an end with gear teeth for meshing with said gear, and spring means for urging said gear axially of said adjusting screw means to a position relative thereto whereat said gear meshes with said gear teeth, whereat rotation of said changeover lever about said pivot axis rotates said gear and said adjusting screw means and thereby adjusts said platen gap.

6. The improvement claimed in claim 5, wherein said carriage further includes a pedestal mounted on said base plate, said pedestal having a shaft defining said pivot axis about which rotates said changeover lever, and an ink ribbon cartridge mounted on said pedestal.

* * * * *